US009789535B2

(12) United States Patent
Roley

(10) Patent No.: US 9,789,535 B2
(45) **Date of Patent: *Oct. 17, 2017**

(54) METHOD OF CATCHING OVERFLOW OF A LIQUID FLUID UTILIZED TO CAST A COMPONENT

(71) Applicant: Grede LLC, Southfield, MI (US)

(72) Inventor: Kenneth Roley, Century, FL (US)

(73) Assignee: Grede LLC, Southfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/810,891

(22) Filed: Jul. 28, 2015

(65) Prior Publication Data

US 2016/0151830 A1 Jun. 2, 2016

Related U.S. Application Data

(63) Continuation of application No. 14/449,235, filed on Aug. 1, 2014, now Pat. No. 9,089,895.

(60) Provisional application No. 61/862,251, filed on Aug. 5, 2013.

(51) Int. Cl.

| | |
|---|---|
| ***B22C 9/02*** | (2006.01) |
| ***B22C 19/00*** | (2006.01) |
| ***B22C 15/02*** | (2006.01) |
| ***B22C 9/08*** | (2006.01) |
| ***B22D 45/00*** | (2006.01) |

(52) U.S. Cl.

CPC ..... *B22C 9/08* (2013.01); *B22C 9/02* (2013.01); *B22C 15/02* (2013.01); *B22C 19/00* (2013.01); *B22D 45/00* (2013.01)

(58) Field of Classification Search

CPC ..... B22C 15/02; B22C 19/00; B22C 9/02

USPC ..... 164/161

See application file for complete search history.

(56) References Cited

U.S. PATENT DOCUMENTS

| | | | | |
|---|---|---|---|---|
| 8,469,080 | B2 | 6/2013 | Shan et al. | |
| 8,636,049 | B2 | 1/2014 | Oya et al. | |
| 9,089,895 | B2 * | 7/2015 | Roley | B22D 45/00 164/17 |
| 9,095,895 | B2 * | 8/2015 | Roley | B22D 45/00 164/17 |
| 2013/0240169 | A1 | 9/2013 | Shan et al. | |

* cited by examiner

*Primary Examiner* — Kevin E Yoon

(74) *Attorney, Agent, or Firm* — McDonald Hopkins LLC

(57) ABSTRACT

A method of catching overflow of a liquid fluid utilized to cast a component is disclosed. Sand is compacted to form a mold. A cutter of a cutting device is in a disengaged position spaced from a top surface of the mold when the cutting device is in a first position and the cutter is in an engaged position engaging the top surface of the mold when the cutting device is in a second position. The cutter is actuated when the cutting device is in the second position and the cutter is in the engaged position to remove sand from the top surface to define a recess therein to catch overflow of the liquid fluid. The recess is spaced from an opening. At least one blocking mechanism, blowing mechanism and adjustment mechanism is utilized to assist the cutting device.

15 Claims, 8 Drawing Sheets

METHOD OF CATCHING OVERFLOW OF A LIQUID FLUID UTILIZED TO CAST A COMPONENT

CROSS-REFERENCE TO RELATED APPLICATIONS

This application is a continuation of U.S. patent application Ser. No. 14/449,235, filed on Aug. 1, 2014 and entitled Method of Catching Overflow of a Liquid Fluid Utilized to Cast a Component, which claims the benefit of U.S. Provisional Application No. 61/862,251, filed on Aug. 5, 2013, which are both hereby incorporated by reference in their entirety.

TECHNICAL FIELD

The present disclosure relates to a method of catching overflow of a liquid fluid utilized to cast a component.

BACKGROUND

Molds have been developed to cast various components. One type of mold is formed of compacted sand. Inside the mold is a cavity configured in a desired pattern to create the desired component. A top of the mold defines a pour cup in fluid communication with the cavity. Molten metal is poured into the pour cup of the mold and fills the cavity to create the component. Various techniques can be used to prevent molten metal from overflowing or expelling from one pour cup and entering an adjacent pour cup. This is because the molten material that enters the adjacent pour cup could begin to cool before additional molten metal poured into that cavity begins to cure.

One technique to address the situation above has been to lay a carbon bar across the top of the mold to separate two pour cups. Therefore, the carbon bar extends upwardly, away from the top of the mold. If molten metal overflows or is expelled out of one pour cup, this molten metal will flow into the carbon bar. However, the molten metal that engages the carbon bar will cool and attach to the carbon bar causing build up. The carbon bar can be replaced as the excessive build up on the carbon bar could cause sand to be dragged into the adjacent pour cup or could cause the carbon bar to rise away from the top of the mold to allow molten metal to flow under the carbon bar and into the adjacent pour cup.

SUMMARY

The present disclosure provides a method of catching overflow of a liquid fluid utilized to cast a component. Sand is compacted to form a mold. The mold includes a first side and a second side spaced from each other along a first axis. The mold also includes a top surface between the first and second sides, and the top surface defines an opening. A cutting device moves along a second axis transverse to the first axis between a first position and a second position. The cutter is in a disengaged position spaced from the top surface of the mold when the cutting device is in the first position and the cutter is in an engaged position engaging the top surface of the mold when the cutting device is in the second position. A cutter of the cutting device is actuated when the cutting device is in the second position and the cutter is in the engaged position to remove sand from the top surface to define a recess therein to catch overflow of the liquid fluid. Furthermore, the recess is spaced from the opening. At least one of a blocking mechanism, a blowing mechanism and an adjustment mechanism is utilized to assist the cutting device.

The detailed description and the drawings or Figures are supportive and descriptive of the disclosure, but the scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Those having ordinary skill in the art will recognize that terms such as "above", "below", "upward", "up", "downward", "down", "top", "bottom", etc., are used descriptively for the figures, and do not represent limitations on the scope of the invention, as defined by the appended claims. Furthermore, the disclosure can be described herein in terms of functional and/or logical block components and/or various processes. It should be realized that such block components can be realized by any number of hardware, software, and/or firmware components configured to perform the specified functions. Furthermore, the term "substantially" can refer to a slight imprecision or slight variance of a condition, quantity, value, or dimension, etc., some of which that are within manufacturing variance or tolerance ranges that can be subject to human or manufacturing error.

Figure 1:
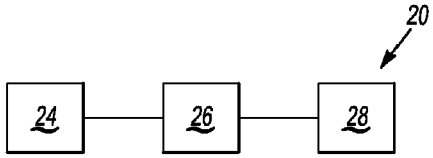
FIG. 1 is a schematic flowchart of an overflow system.

Referring to the Figures, wherein like numerals indicate like or corresponding parts throughout the several views, an overflow system 20 for casting a component 22 (see FIG. 6) is generally shown in FIG. 1. The overflow system 20 can include a mold forming process 24, a trenching process 26 and a pouring process 28 as shown in FIG. 1.

Figure 2:
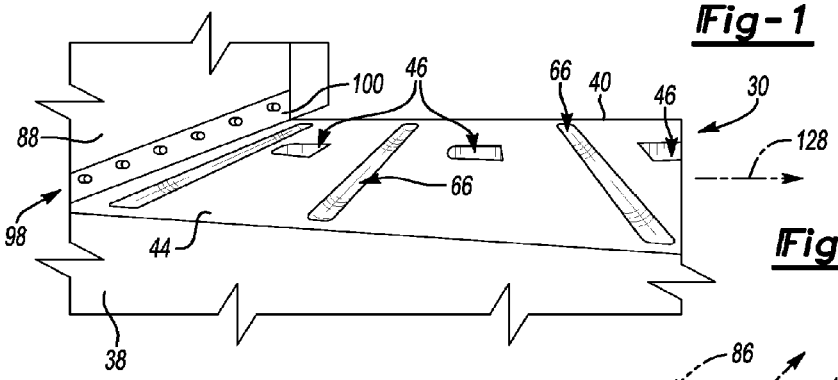
FIG. 2 is a schematic perspective fragmentary view of a mold exiting a trenching assembly.
Figure 6:
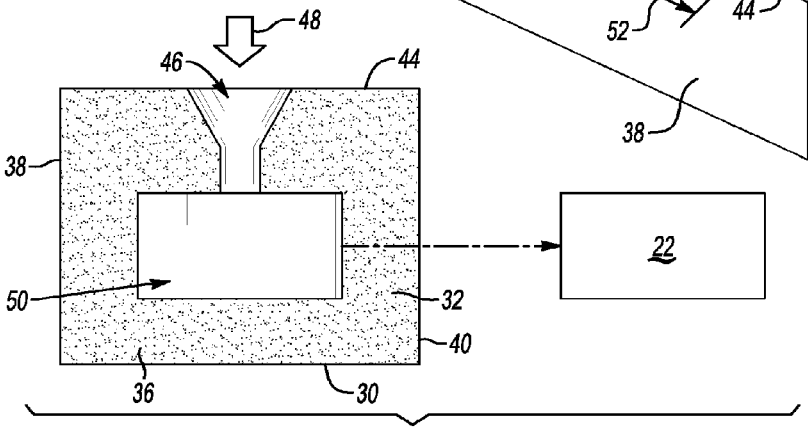
FIG. 6 is a schematic cross-sectional view of the mold, with a component created from the mold spaced therefrom.

Referring to FIG. 2, the system 20 includes a mold 30 formed of sand 32 (see FIG. 6). The mold 30 can be formed during the mold forming process 24 before entering the trenching process 26. The mold 30 can move along a conveyor 34 (see FIGS. 3 and 4). Generally, the mold 30 moves from the mold forming process 24 to the trenching process 26 and then to the pouring process 28. It is to be appreciated that the mold 30 can move from one process to another process by any suitable method(s) and the conveyor 34 is one example.

Generally, the sand 32 can be silica sand or any other suitable sand. As such, the mold 30 can be referred to as a sand mold. The sand 32 is combined with a binding agent 36 (see FIG. 6) to hold the sand 32 together to form the mold 30. For example, the binding agent 36 can be clay or any other suitable binding agent 36. The binding agent 36 and the sand 32 can be mixed, blended, etc., to hold, bind, attach, etc., the sand 32 together to form the mold 30. It is to be appreciated that water or any other suitable liquid or substance can be utilized to combine the sand 32 and the binding agent 36 to hold the sand 32 together.

Figure 5:
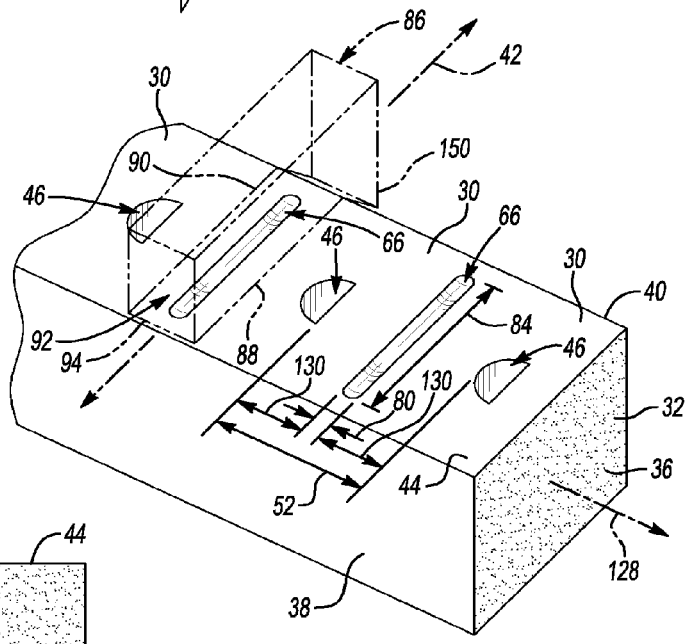
FIG. 5 is a schematic perspective fragmentary view of the mold, with a blocking mechanism generally illustrated in phantom lines.

Referring to FIGS. 5 and 6, the mold 30 includes a first side 38 and a second side 40 spaced from each other along a first axis 42. Furthermore, the mold 30 includes a top surface 44 between the first and second sides 38, 40. The top surface 44 defines an opening 46 for receiving a liquid fluid 48 (see FIG. 6). The opening 46 can be referred to as a pour cup. Simply stated, the liquid fluid 48 is poured into the pour cup.

Referring to FIG. 6, the mold 30 also defines a cavity 50 in fluid communication with the opening 46 such that the liquid fluid 48 flows into the cavity 50 to create the component 22. Therefore, the liquid fluid 48 is poured into the opening 46 and flows into the cavity 50. The cavity 50 presents a pattern or template of the desired component 22 to be created. Simply stated, the component 22 is cast in the cavity 50 of the mold 30. For example, the component 22 being casted can be a brake caliper, a brake adapter, a hub or any other component 22 able to be casted utilizing the sand mold 30. It is to be appreciated that various other features (such as a riser, etc.) have been eliminated in the cross-sectional view of the mold 30 in FIG. 6 for simplicity, and these other features can optionally be added to the mold 30.

Generally, the liquid fluid 48 can be a molten material such as a molten metal material. Once the molten material cools inside the mold 30, the casted component 22 can be removed from the mold 30. The molten metal material can be steel, iron, bronze, brass, aluminum, alloys or combinations thereof. One suitable example of an alloy is magnesium alloy. Furthermore, the molten metal material can be pot metal alloys which can include lead, tin, zinc, etc. It is to be appreciated that any suitable liquid fluid 48 can be utilized to create the component 22.

A plurality of molds 30 can be formed in the mold forming process 24 as shown in FIGS. 2 and 5. Each of the molds 30 define one opening 46 for receiving the liquid fluid 48 and each of the molds 30 define one cavity 50 to create one component 22. These molds 30 can form one continuous top surface 44, one continuous first side 38 and one continuous second side 40 as shown in FIGS. 2 and 5. Any suitable number of molds 30 can be utilized to create the desirable number of components 22. The openings 46 of adjacent molds 30 are spaced from each other a predetermined total distance 52 (see FIG. 5).

Figure 3:
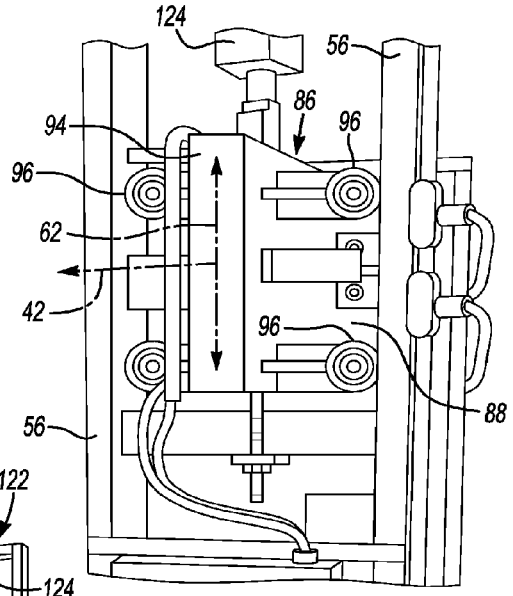
FIG. 3 is a schematic perspective fragmentary view of the trenching assembly.
Figure 4:
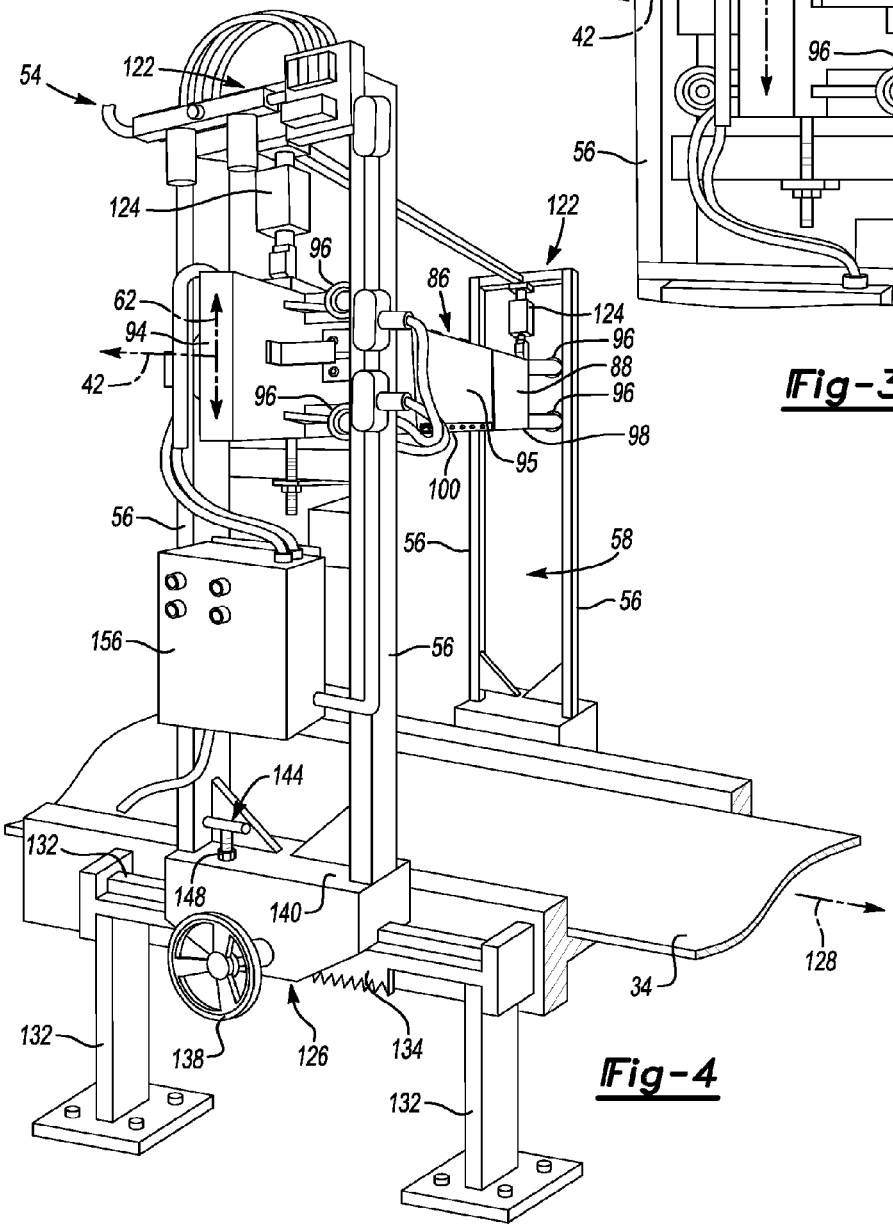
FIG. 4 is a schematic perspective view of the trenching assembly, with a conveyor fragmented.
Figure 7:
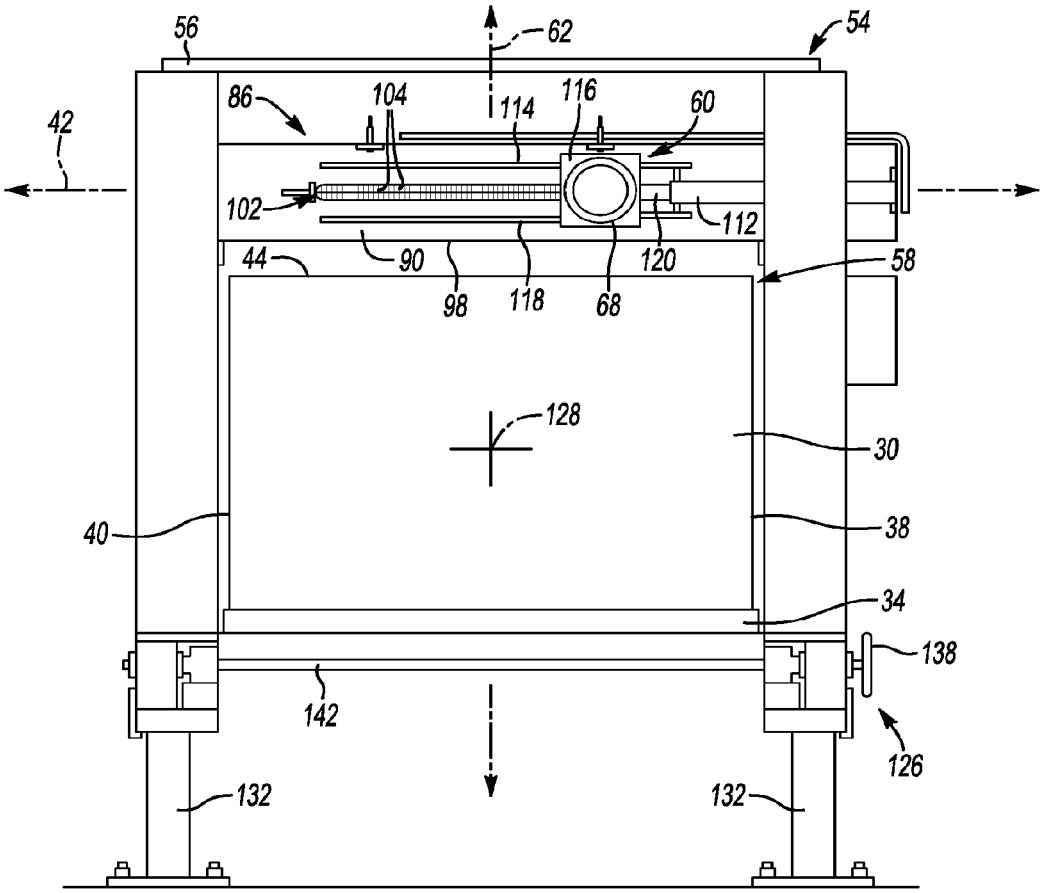
FIG. 7 is a schematic side view of the trenching assembly with the mold in a window of a frame, and with the blocking mechanism and the cutting device in a first position, and the cutting device in an initial position.

The system 20 also includes a trenching assembly 54 as best shown in FIGS. 3, 4 and 7. Simply stated, the trenching process 26 is performed by the trenching assembly 54. The trenching assembly 54 includes a frame 56 configured to receive the mold 30. More specifically, the frame 56 can define a window 58 for receiving the mold 30. As such, the opening 46 of the mold 30 moves from one side of the trenching assembly 54 through the window 58 and to the other side of the trenching assembly 54. After utilizing the trenching assembly 54, the mold 30 continues to move along the conveyor 34 to the pouring process 28, where the liquid fluid 48 is poured into the opening 46 of the mold 30 to create the component 22.

Turning to FIGS. 8-11, the trenching assembly 54 also includes a cutting device 60 operatively coupled to the frame 56. The cutting device 60 moves along the first axis 42 between an initial position (see FIG. 8) and a final position (see FIG. 11). In other words, the cutting device 60 moves back and forth along the first axis 42 between the initial and final positions. It is to be appreciated that the phrase "along the first axis 42" can include substantially parallel to the first axis 42 or collinearly with the first axis 42.

Figure 8:
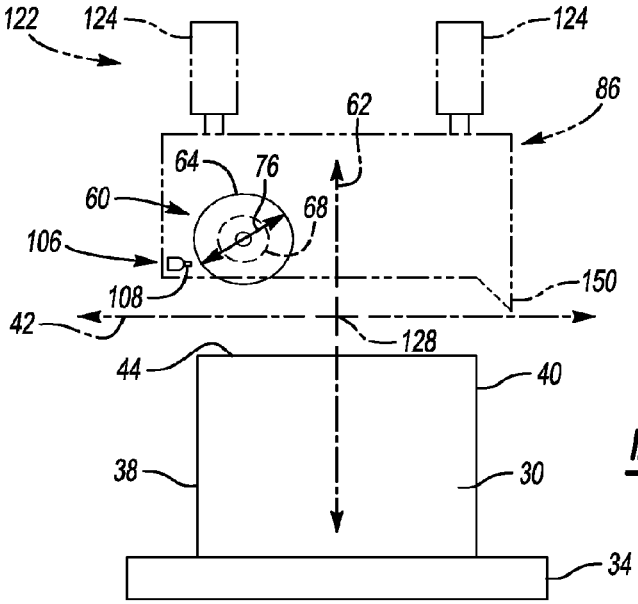
FIG. 8 is a schematic end view of the mold on the conveyor, with the blocking mechanism and a collection bin shown in phantom lines and in the first position, and with a cutting device and a blowing mechanism in the first position spaced from the mold, and with the cutting device in the initial position.
Figure 11:
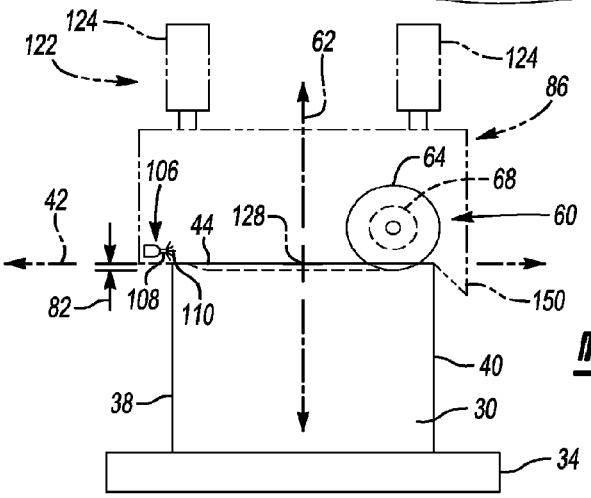
FIG. 11 is a schematic end view of the mold on the conveyor, with the blocking mechanism and the collection bin shown in phantom lines and in the second position, and with the cutting device and the blowing mechanism in the second position, and with the cutting device in a final position and the blowing device expelling a gaseous fluid.

Furthermore, the cutting device 60 is movable relative to the frame 56 along a second axis 62 transverse to the first axis 42 between a first position (see FIG. 8) and a second position (see FIG. 11). Simply stated, the cutting device 60 moves up and down relative to the top surface 44 of the mold 30 between the first and second positions. For example, as shown in FIG. 8, the first position can be when the cutting device 60 is retracted away from the top surface 44, and as shown in FIG. 11, the second position can be when the cutting device 60 engages the top surface 44. It is to be appreciated that the phrase "along the second axis 62" can include substantially parallel to the second axis 62 or collinearly with the second axis 62.

Figure 9:
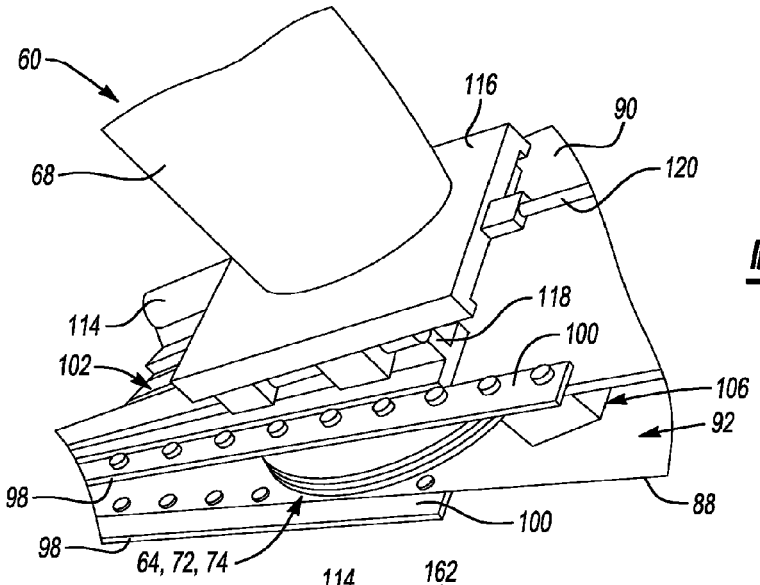
FIG. 9 is a schematic perspective fragmentary view of the cutting device and the blocking mechanism, with a plurality of cutters and a blowing mechanism disposed in a gap between a first partition and a second partition of the blocking mechanism.
Figure 10:
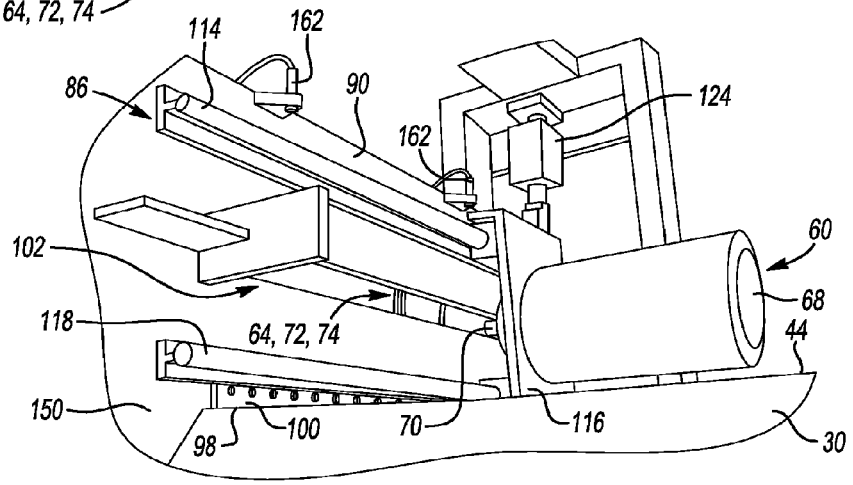
FIG. 10 is a schematic perspective view of the cutting device in the initial position, and with the blocking mechanism, the cutting device and the collection bin in a second position, with the mold, the blocking mechanism and the collection bin fragmented.

Furthermore, as shown in FIGS. 9 and 10, the cutting device 60 includes a cutter 64. The cutter 64 is in a disengaged position spaced from the top surface 44 of the mold 30 when the cutting device 60 is in the first position (see FIG. 8) and the cutter 64 is in an engaged position engaging the top surface 44 of the mold 30 when the cutting device 60 is in the second position (see FIG. 11). In other words, when the cutting device 60 is retracted away from the top surface 44, the cutter 64 is spaced from the top surface 44, and when the cutting device 60 moves toward the top surface 44, the cutter 64 engages the top surface 44.

As best shown in FIGS. 2 and 5, generally, the cutter 64 defines a recess 66 in the top surface 44 when the cutter 64 is in the engaged position. In other words, when the cutter 64 is actuated in the engaged position, the cutter 64 removes material, e.g., sand 32, from the top surface 44 of the mold 30 to create the recess 66. Therefore, the cutter 64 can grind, cut, etc., the top surface 44 to create the recess 66. Generally, the recess 66 is spaced from the opening 46 for receiving excess liquid fluid 48. More specifically, the recess 66 is disposed between adjacent openings 46 of adjacent molds 30 (see FIG. 5). Specifically, the recess 66 catches excess molten material during the pouring process 28, which prevents this molten material from entering the next opening 46 of the next mold 30.

As best shown in FIGS. 7, 9, 10 and 12, the cutting device 60 can include an electric motor 68. The cutter 64 is operatively coupled to the electric motor 68 such that activation of the electric motor 68 moves or rotates the cutter 64. Therefore, the electric motor 68 can be actuated or activated to move the cutter 64. Additionally, the cutting device 60 can include an output shaft 70 (see FIG. 10) operatively coupled to the electric motor 68. Generally, the cutter 64 is attached to the output shaft 70 such that the output shaft 70 and the cutter 64 rotate in unison when the electric motor 68 is activated. In one embodiment, the electric motor 68 can output one horsepower (1 hp). It is to be appreciated that the electric motor 68 can output any suitable amount of horsepower.

Generally, the cutter 64 is further defined as a first cutter 64, and in one embodiment, the cutting device 60 includes a second cutter 72 (see FIGS. 9, 10 and 13) operatively coupled to the electric motor 68 and abutting the first cutter 64. In this embodiment, the first and second cutters 72 rotate in unison when the electric motor 68 is activated. More specifically, the first and second cutters 72 are each attached to the output shaft 70 to rotate in unison therewith. In another embodiment, the cutting device 60 also includes a third cutter 74 (see FIGS. 9, 10 and 13) operatively coupled to the electric motor 68 and abutting one of the first and second cutters 64, 72. In this embodiment, the first, second and third cutters 64, 72, 74 rotate in unison when the electric motor 68 is activated. More specifically, the first, second and third cutters 64, 72, 74 are each attached to the output shaft 70 to rotate in unison therewith. Generally, the first, second and third cutters 64, 72, 74 are configured substantially the same.

Furthermore, the first, second and third cutters 64, 72, 74 can each define an outer diameter 76 (see FIG. 8) being a generally circular configuration. In one embodiment, each of the cutters 64, 72, 74 define the outer diameter 76 of from about 304.80 millimeters (mm). In another embodiment, each of the cutters 64, 72, 74 define the outer diameter 76 of from about 355.60 mm. It is to be appreciated that the outer diameter 76 of the first, second and third cutters 64, 72, 74 can each be any suitable diameter to create the recess 66 being of a desired configuration.

In certain embodiments, the first, second and third cutters 64, 72, 74 are formed of an abrasive material for removing sand 32 from the top surface 44 of the mold 30 to create the recess 66. It is to be appreciated that any suitable abrasive material can be utilized for the first, second and third cutters 64, 72, 74. For example, the abrasive material can be similar to that used in a grinding wheel application. It is to further be appreciated that the cutters 64, 72, 74 can be any suitable configuration, such as a blade, a saw, etc., and can be formed of metal or any other suitable materials.

Generally, the first, second and third cutters 64, 72, 74 are stacked together to define a total width 78 (see FIG. 13) which corresponds to a width 80 (see FIG. 5) of the recess 66 being created. Generally, the total width 78 of the cutters 64, 72, 74 can be of from about 6.35 mm to about 19.05 mm, and therefore, the width 80 of the recess 66 can be of from about 6.35 mm to about 19.05 mm. In one embodiment, the total width 78 of the cutters 64, 72, 74 can be of from about 12.70 mm, and therefore, the width 80 of the recess 66 can be of from about 12.70 mm. It is to be appreciated that any suitable number of cutters 64, 72, 74, i.e., one or more, can be utilized to define the desired total width 78 corresponding to the desired width 80 of the recess 66.

Additionally, as shown in FIG. 11, the cutter 64, and more specifically, the first, second and third cutters 64, 72, 74, engage the top surface 44 when in the engaged position to define the recess 66 having a depth 82. In other words, the first, second and third cutters 64, 72, 74 remove sand 32 from the top surface 44 to define the depth 82 of the recess 66. Generally, the depth 82 of the recess 66 can be of from about 6.35 mm to about 19.05 mm. In one embodiment, the depth 82 of the recess 66 can be of from about 12.70 mm. It is to be appreciated that the cutters 64, 72, 74 can extend into the top surface 44 any desired depth 82 corresponding to the desired depth 82 of the recess 66.

The cutter 64, and more specifically, the cutters 64, 72, 74, can engage the top surface 44 of the mold 30 between the initial and final positions to define the recess 66 presenting a predetermined length 84 (see FIG. 5) between the first and second sides 38, 40. Specifically, as shown in FIGS. 5 and 11, the recess 66 is spaced from the first and second sides 38, 40 to prevent the liquid fluid 48 from flowing down the first and second sides 38, 40. In other words, any excess liquid fluid 48 that fills the recess 66 will be contained in the recess 66 and will not flow over the top surface 44 to the first and second sides 38, 40. Generally, the recess 66 can be spaced from the first side 38 of from about 6.35 mm to about 19.05 mm and spaced from the second side 40 of from about 6.35 mm to about 19.05 mm. In one embodiment, the recess 66 can be spaced from the first side 38 of from about 12.70 mm and spaced from the second side 40 of from about 12.70 mm.

Referring to FIGS. 3, 4, 8, 9 and 13, the trenching assembly 54 further includes a mechanism 86, 106, 126 that can assist the cutting device 60. Specifically, at least one of a blocking mechanism 86, a blowing mechanism 106 and an adjustment mechanism 126 is utilized to assist the cutting device 60. Said differently, at least one of the blocking mechanism 86, the blowing mechanism 106 and the adjustment mechanism 126 assists the cutting device 60. The phrase "at least one of" as used herein should be construed to include the non-exclusive logical "or", i.e., at least one of the blocking mechanism 86 and/or the blowing mechanism 106 and/or the adjustment mechanism 126. Therefore, in certain embodiments, the blocking mechanism 86 or the blowing mechanism 106 or the adjustment mechanism 126 assists the cutting device 60. In other embodiments, the blocking mechanism 86 and/or the blowing mechanism 106 and/or the adjustment mechanism 126, i.e., any combination of these mechanisms 86, 106, 126. Each of these mechanisms 86, 106, 126 are discussed in detail below.

As best shown in FIG. 4, the blocking mechanism 86 is operatively coupled to the cutting device 60 and the frame 56. The cutting device 60 is generally supported by the blocking mechanism 86 and the frame 56. The blocking mechanism 86 and the cutting device 60 are movable in unison relative to the frame 56 along the second axis 62 between the first and second positions. In other words, the blocking mechanism 86 and the cutting device 60 move up and down in unison relative to the top surface 44 of the mold 30 between the first and second positions. Generally, the blocking mechanism 86 contains an area of the top surface 44 where the recess 66 is to be created. Therefore, the blocking mechanism 86 selectively engages the top surface 44 of the mold 30 between two openings 46 (see FIG. 5). FIG. 8 illustrates a schematic of the blocking mechanism 86 in phantom lines in the first position, e.g., up, and FIG. 11 illustrates a schematic of the blocking mechanism 86 in phantom lines in the second position, e.g., down, and it is to be appreciated that the blocking mechanism 86 in FIGS. 8 and 11 can include other features not shown in these illustrations. Furthermore, the cutting device 60 moves independently of the blocking mechanism 86 between the initial and final positions. In other words, the cutting device 60 moves back and forth along the first axis 42 independently of the blocking mechanism 86. Therefore, the blocking mechanism 86 does not move between the initial and final positions, e.g., back and forth, along the first axis 42. It is to be appreciated that movement along the second axis 62 can be adjusted depending on the size of the molds 30.

Referring to FIGS. 5, 7, 10, 12 and 13, the blocking mechanism 86 can include a first partition 88 extending toward the top surface 44 of the mold 30. The first partition 88 is spaced from the top surface 44 when in the first position and engages the top surface 44 when in the second position to separate the opening 46 and the recess 66. Furthermore, the blocking mechanism 86 can include a second partition 90 extending toward the top surface 44 of the mold 30 and spaced from the first partition 88 to define a gap 92 (see FIGS. 5, 9 and 13) between the first and second partitions 88, 90. The second partition 90 separates another opening 46 and the recess 66. The second partition 90 is spaced from the top surface 44 when in the first position and engages the top surface 44 when in the second position. The first and second partitions 88, 90 are coupled to each other and move in unison with each other between the first and second positions. The recess 66 is created between the first and second partitions 88, 90 such that the first and second partitions 88, 90 cooperate to contain the sand 32 removed from the top surface 44 of the mold 30 by the cutter 64, and more specifically, the cutters 64, 72, 74. Therefore, the first and second partitions 88, 90 remain in the second position as the cutting device 60 moves from the initial position to the final position as the cutter 64, and more specifically, the cutters 64, 72, 74, engage the top surface 44 in the engaged position. As such, when the blocking mechanism 86 is in the second position, the sand 32 being removed cannot enter either of the adjacent openings 46 as the recess 66 is being created. Various features of the blocking mechanism 86 are eliminated in FIG. 5 and the first and second partitions 88, 90 are shown in phantom lines in FIG. 5 for illustrative purposes only to illustrate the recess 66 separated from two adjacent openings 46. It is to be appreciated that the blocking mechanism 86 can include additional partitions 88, 90, 94, for example, a third partition 94 (see FIGS. 3 and 4) connecting the first and second partitions 88, 90 to enclose an end of the blocking mechanism 86 between the first and second partitions 88, 90. It is to also be appreciated that the third partition 94 can be any suitable location and different locations are illustrated in FIGS. 4, 5 and 11. For example, the third partition 94 can extend beyond the first side 38 of the mold 30 (see FIGS. 4 and 11) or the third partition 94 can be disposed over the mold 30 (see FIG. 5).

Figure 20:
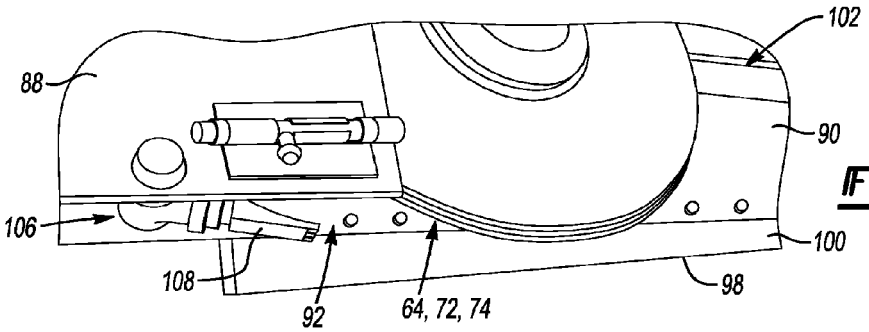
FIG. 20 is a schematic perspective view of the blowing mechanism attached to the blocking mechanism which is fragmented, with a door of the blocking mechanism in an open position to illustrate the first, second and third cutters between the first and second partitions.
Figure 21:
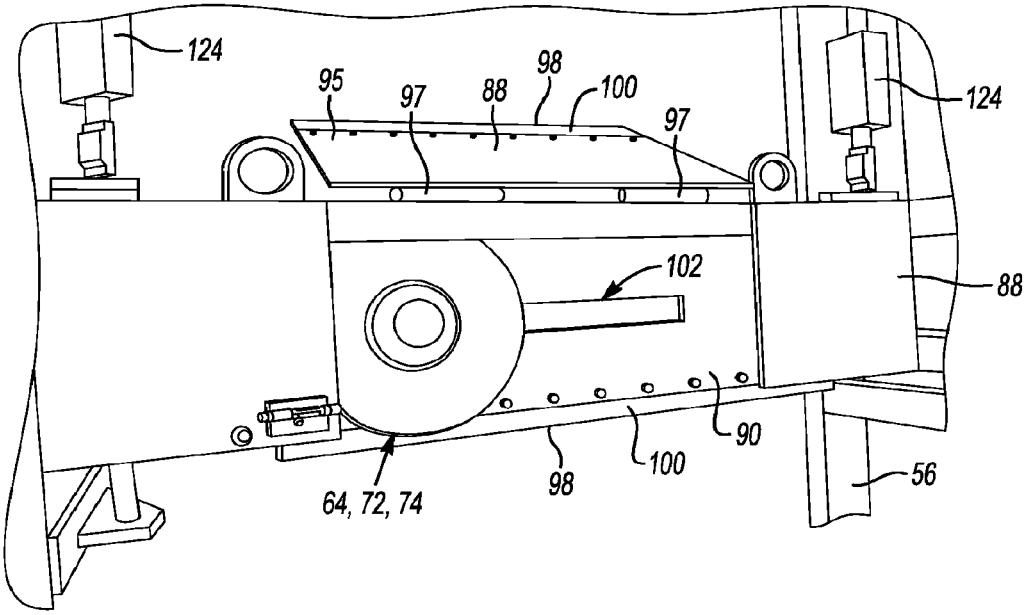
FIG. 21 is a schematic perspective view of the door of the blocking mechanism in the open position.

Optionally, as shown in FIG. 21, the blocking mechanism 86 can include a door 95 movable between an open position and a closed position. Specifically, one of the first and second partitions 88, 90 can include the door 95. The door 95 provides accessibility to various parts disposed in the gap 92, such as for example, the cutters 64, 72, 74, etc. In FIG. 21, the first partition 88 includes the door 95. The door 95 can move or rotate on one or more hinges 97 as shown in FIG. 21. The door 95 is shown in the open position in FIGS. 20 and 21. The closed position of the door 95 is shown in FIG. 4. It is to be appreciated that the first or second partitions 88, 90 can be utilized without the door 95, i.e., the door 95 can be eliminated.

Turning to FIGS. 3 and 4, the blocking mechanism 86 can also include a plurality of rollers 96 engaging the frame 56. The rollers 96 move in unison with the first and second partitions 88, 90 between the first and second positions along the second axis 62. Therefore, the rollers 96 move up and down the frame 56. The rollers 96 are rotatably attached to the first and second partitions 88, 90 and maintain the position of the blocking mechanism 86 laterally relative to frame 56. Only some of the rollers 96 are visible in FIG. 3 and it is to be appreciated that a similar configuration of the rollers 96 are attached to the first and second partitions 88, 90 on the opposite side of the frame 56, and some of these other rollers 96 are generally shown in FIG. 4.

The first and second partitions 88, 90 can each extend toward the top surface 44 to a distal end 98 selectively engaging the top surface 44 of the mold 30. When the distal end 98 of the first and second partitions 88, 90 engage the top surface 44 of the mold 30, the distal ends 98 seal therebetween which minimizes the sand 32 removed by the cutter(s) 64, 72, 74 from exiting between the first and second partitions 88, 90 and the top surface 44. Furthermore, as best shown in FIGS. 9 and 10, a portion of the first and second partitions 88, 90 at respective distal ends 98 can be flexible to seal between the top surface 44 of the mold 30 and first and second partitions 88, 90 to minimize sand 32 removed by the cutter(s) 64, 72, 74 from exiting between the first and second partitions 88, 90 and the top surface 44. As such, the portion of the first and second partitions 88, 90 can each define a flexible seal 100. The flexible seal 100 can be compressible or elastically deformable such that the flexible seal 100 generally returns to its original configuration when the first and second partitions 88, 90 are spaced from the top surface 44 of the mold 30. The flexible seal 100 can be other configurations than illustrated, such as for example, the flexible seal can be a bead, be rounded, etc. instead of a rectangular strip as illustrated. Furthermore, the flexible seal 100 is optional and is removed in FIG. 7.

Referring to FIGS. 7 and 10, one of the first and second partitions 88, 90 defines a slot 102. In one embodiment, the second partition 90 defines the slot 102 (see FIGS. 7 and 10). The output shaft 70 extends through the slot 102 and the cutter 64 is disposed in the gap 92 between the first and second partitions 88, 90. More specifically, the first, second and third cutters 64, 72, 74 are disposed in the gap 92 between the first and second partitions 88, 90. Therefore, the total width 78 of the cutters 64, 72, 74 is less than the width 80 of the gap 92 (see FIG. 13) such that the cutters 64, 72, 74 are spaced from the first and second partitions 88, 90. Furthermore, the slot 102 is elongated such that the cutting device 60 can move along the first axis 42 between the initial and final positions.

In addition, referring to FIG. 7, a cover 104, such as brushes, etc., can be disposed in the slot 102. The output shaft 70 engages the cover 104. The cover 104 is disposed in the slot 102 to minimize sand 32 removed by the cutter(s) 64, 72, 74 from exiting the slot 102 while allowing movement of the output shaft 70 along the slot 102 between the initial and final positions. It is to be appreciated that the cover 104 can be other configurations other than brushes. Furthermore, the cover 104 is optional and is removed in many Figures which can be to illustrate other features.

Figure 13:
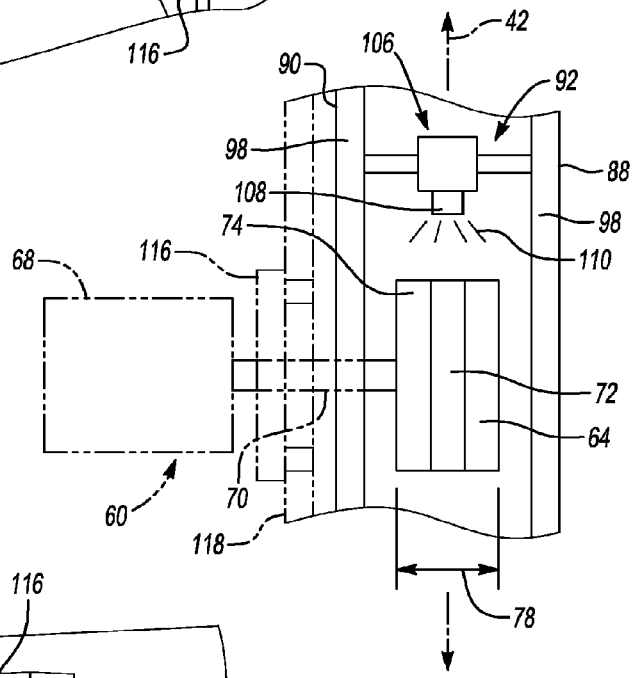
FIG. 13 is a schematic fragmentary bottom view of the first and second partitions, with the blowing mechanism and a first cutter, a second cutter and a third cutter disposed in the gap, and with the blowing mechanism expelling the gaseous fluid, and with a guide and a bracket in phantom lines, as well as an output shaft and an electric motor of the cutting device in phantom lines.

In certain embodiments, the blowing mechanism 106 can be coupled to the blocking mechanism 86 to move the sand 32 removed from the top surface 44 of the mold 30 by the cutter 64 toward one of the first and second sides 38, 40 of the mold 30. As best shown in FIG. 13, the blowing mechanism 106 is disposed in the gap 92 between the first and second partitions 88, 90 of the blocking mechanism 86.

Continuing with FIG. 13, the blowing mechanism 106 can include a nozzle 108 for expelling a gaseous fluid 110 out of the nozzle 108 to move the sand 32 removed from the top surface 44 of the mold 30 toward one of the first and second sides 38, 40 of the mold 30. The blowing mechanism 106 is actuated in FIGS. 11 and 13 to illustrate the gaseous fluid 110 being expelled toward the cutter(s) 64, 72, 74. For example, in FIG. 11, the expelled gaseous fluid 110 moves the cut sand 32 toward the second side 40 of the mold 30. In one embodiment, the gaseous fluid 110 is air. It is to be appreciated that the gaseous fluid 110 can be any suitable gaseous fluid 110. It is to also be appreciated that any suitable pressure can be utilized to expel the gaseous fluid 110 out the nozzle 108 and move the cut sand 32.

As shown in FIGS. 8, 9, 11, 13 and 20, the blowing mechanism 106 can be attached to the blocking mechanism 86 to move the sand 32 removed from the top surface 44 of the mold 30 by the cutter 64 toward one of the first and second sides 38, 40 of the mold 30. As discussed above, the blowing mechanism 106 is disposed in the gap 92 between the first and second partitions 88, 90 of the blocking mechanism 86. Specifically, the blowing mechanism 106 can be attached to at least one of the first and second partitions 88, 90. Therefore, the blowing mechanism 106 can be attached to the first partition 88 in the gap 92 or the second partition 90 in the gap 92, and in other embodiments, such as the embodiment of FIGS. 13 and 20, the blowing mechanism 106 can be attached to both the first and second partitions 88, 90 in the gap 92. Therefore, the blowing mechanism 106 remains stationary as the cutting device 60 moves between the initial and final positions along the first axis 42 (compare FIGS. 8 and 11). The blowing mechanism 106 moves the cut sand 32 in the same direction that the cutting device 60 is moving along the first axis 42 during cutting. In this embodiment, the blowing mechanism 106 moves in unison with the blocking mechanism 86 and the cutting device 60 between the first and second positions along the second axis 62. In other words, the blowing mechanism 106, the blocking mechanism 86 and the cutting device 60 move up and down in unison relative to the top surface 44 of the mold 30 between the first and second positions (see FIGS. 8 and 11). And, in this embodiment, the cutting device 60 moves between the initial and final positions independently of the blocking mechanism 86 and the blowing mechanism 106. Again, the gaseous fluid 110 is expelled out of the nozzle 108 to move the sand 32 removed from the top surface 44 of the mold 30 toward one of the first and second sides 38, 40 of the mold 30. Therefore, even with the blowing mechanism 106 remaining stationary during cutting, the removed stand 32 is blown toward one of the first and second sides 38, 40 of the mold 30.

Alternatively, in certain embodiments, the blowing mechanism 106 and the cutting device 60 can move in unison independently of the blocking mechanism 86 between the initial and final positions. Therefore, as the cutter 64 engages the top surface 44 to create the recess 66, the blowing mechanism 106 moves with the cutter 64 to move the sand 32 removed from the top surface 44 toward one of the first and second sides 38, 40 of the mold 30. Simply stated, the blowing mechanism 106 moves the cut sand 32 in the same direction that the cutting device 60 is moving along the first axis 42 during cutting.

Figure 14:
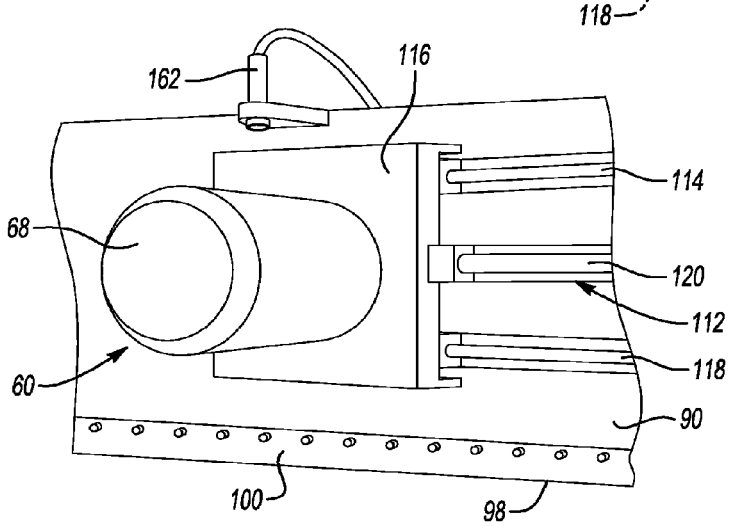
FIG. 14 is a schematic perspective view of the cutting device and a first actuator device fragmented.
Figure 18:
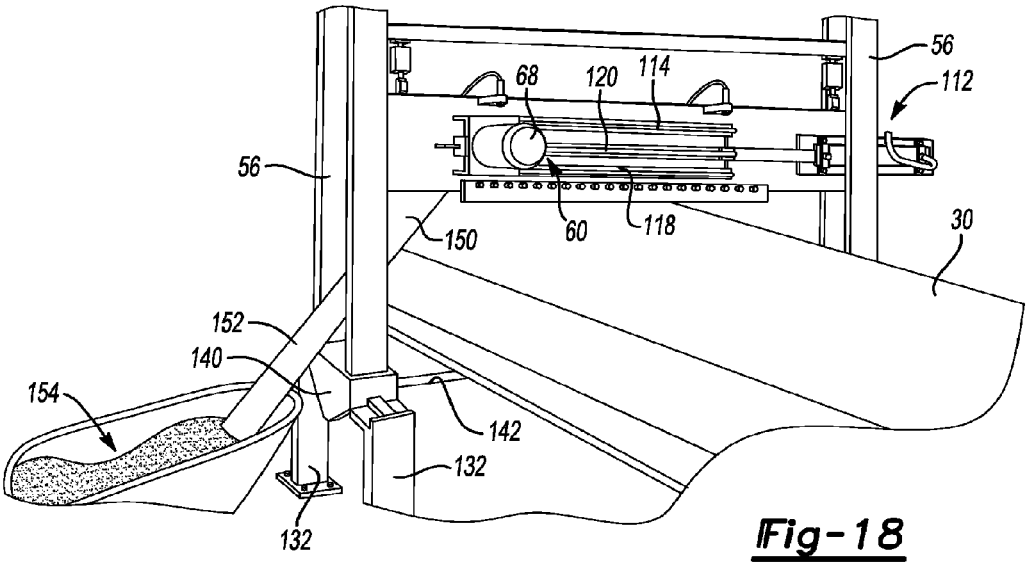
FIG. 18 is a schematic perspective view of the collection bin.

Turning to FIGS. 7, 14 and 18, the trenching assembly 54 can further include a first actuator device 112 operatively coupled to the cutting device 60 to move the cutting device 60 along the first axis 42 between the initial position and the final position. Specifically, the first actuator device 112 can be activated or actuated to move the cutting device 60. Furthermore, the first actuator device 112 can optionally move the blowing mechanism 106 along the first axis 42 between the initial and final positions. Therefore, in certain embodiments, the first actuator device 112 can move both the cutting device 60 and the blowing mechanism 106. The first actuator device 112 can be a hydraulic device, a pneumatic device or any other suitable actuator device.

The first actuator device 112 can include a guide 114, and a bracket 116 attached to the cutting device 60 to support the cutting device 60. More specifically, the guide 114 is attached to one of the first and second partitions 88, 90. In one embodiment, the guide 114 is attached to the second partition 90 as best shown in FIGS. 7 and 10. As such, the bracket 116 is movably attached to the guide 114 such that the cutting device 60 is guided along the first axis 42 between the initial and final positions when the first actuator device 112 is activated. In one embodiment, as best shown in FIGS. 7 and 10, the guide 114 can be further defined as a first guide 114 and the first actuator device 112 can further include a second guide 118 spaced from the first guide 114. The second guide 118 is also attached to one of the first and second partitions 88, 90. For example, the first and second guides 114, 118 can be attached to the second partition 90 (see FIGS. 7 and 10) in a spaced relationship. In this embodiment, the bracket 116 is movably attached to the first and second guides 114, 118 such that the cutting device 60 is guided along the first axis 42 between the initial and final positions when the first actuator device 112 is activated. Turning to FIGS. 7 and 14, the first actuator device 112 can include a piston or rod 120, etc., attached to the bracket 116 to move the bracket 116, and thus the cutting device 60, and in certain embodiments, move the blowing mechanism 106, along the first axis 42 between the initial and final positions.

It is to be appreciated that the first actuator device 112 can include one or more cylinders, one or more pistons or rods 120, or any other suitable parts to move the cutting device 60/blowing mechanism 106 along the first axis 42. The first actuator device 112 can be any suitable configuration and different configurations are illustrated in FIGS. 7 and 18 for illustrative purposes only. In some Figures, the first actuator device 112 is not illustrated.

Turning back to FIGS. 3 and 4, the trenching assembly 54 can also include a second actuator device 122 operatively coupled to the blocking mechanism 86 to move the blocking mechanism 86 and the cutting device 60 in unison relative to the frame 56 along the second axis 62 between the first and second positions independently of the first actuator device 112 moving the cutting device 60 between the initial and final positions. Therefore, the second actuator device 122 does not move along the first axis 42 between the initial and final positions, i.e., remains stationary relative to the first axis 42. Specifically, the second actuator device 122 can be activated or actuated to move the blocking mechanism 86. Furthermore, the first actuator device 112 moves in unison with the blocking mechanism 86 and the cutting device 60 along the second axis 62 between the first and second positions. The second actuator device 122 can be a hydraulic device, a pneumatic device or any other suitable actuator device. Furthermore, the second actuator device 122 can include a plurality of cylinders 124 (see FIG. 4), etc., for moving the blocking mechanism 86 between the first and second positions. It is to be appreciated that the second actuator device 122 can include one or more cylinders 124, one or more pistons or rods, or any other suitable parts to move the blocking mechanism 86/cutting device 60/blowing mechanism 106 along the second axis 62.

As shown in FIGS. 4, 7 and 15-17, the adjustment mechanism 126 is operatively coupled to the cutting device 60 to move the cutting device 60 along a third axis 128 transverse to the first and second axes 42, 62 to adjust a position of the cutter 64 relative to the opening 46 of the mold 30. Simply stated, the adjustment mechanism 126 adjusts the position of the cutter(s) 64, 72, 74 relative to the opening 46 in the top surface 44 of the mold 30. For example, if the size of the molds 30 change, the position or size of the openings 46 can change, and thus, the adjustment mechanism 126 can adjust the position of the cutter(s) 64, 72, 74 to compensate for these size changes. Generally, the mold 30 moves from the trenching process 26 to the pouring process 28 along the third axis 128. Therefore, the conveyor 34 moves along the third axis 128 to move the mold 30 from the trenching process 26 to the pouring process 28. It is to be appreciated that the phrase "along the third axis 128" can include substantially parallel to the third axis 128 or collinearly with the third axis 128.

As indicated above, the cutter 64 creates the recess 66, and therefore, positioning the cutter 64 relative to the opening 46 correspondingly positions the recess 66 a predetermined distance 130 (see FIG. 5) from the opening 46. Therefore, positioning the cutter 64 with the adjustment mechanism 126 can position the location of the recess 66 between two adjacent openings 46. As such, positioning the cutters 64, 72, 74 between two adjacent openings 46 correspondingly positions the recess 66 the predetermined distance 130 between the adjacent openings 46. In certain embodiments, the predetermined total distance 52 between adjacent openings 46 is of from about 69.85 mm to about 95.25 mm. More specifically, in certain embodiments, the predetermined total distance 52 between adjacent openings 46 is of from about 76.20 mm to about 88.90 mm. Therefore, in certain embodiments, the predetermined distance 130 of the recess 66 is less than 69.85 mm when the predetermined total distance 52 is about 69.85 mm and is less than 95.25 mm when the predetermined total distance 52 is about 95.25 mm. More specifically, in certain embodiments, the predetermined distance 130 of the recess 66 is less than 76.20 mm when the predetermined total distance 52 is about 76.20 mm and less than 88.90 mm when the predetermined total distance 52 is about 88.90 mm. In one embodiment, the predetermined distance 130 of the recess 66 is of from about 38.10 mm. In another embodiment, the predetermined distance 130 of the recess 66 is of from about 44.45 mm. It is to be appreciated that the recess 66 can be positioned any suitable distance between adjacent openings 46.

Figure 15:
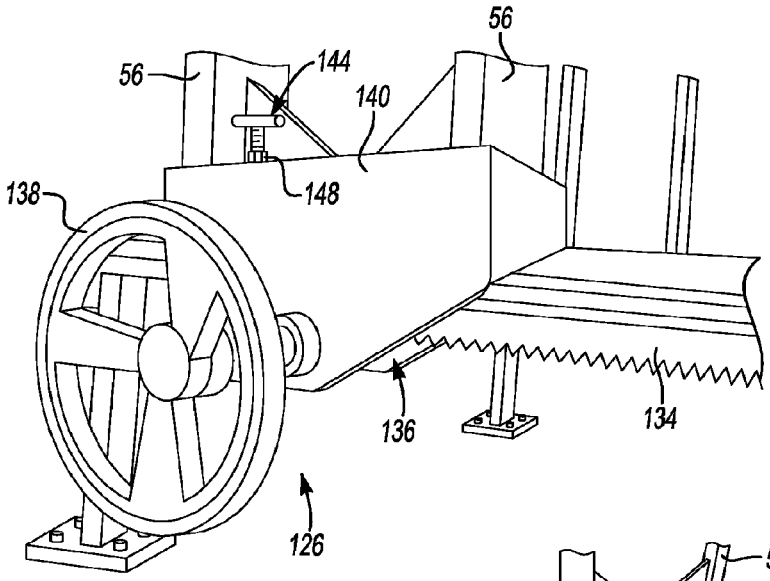
FIG. 15 is a schematic perspective view of an adjustment mechanism.
Figure 16:
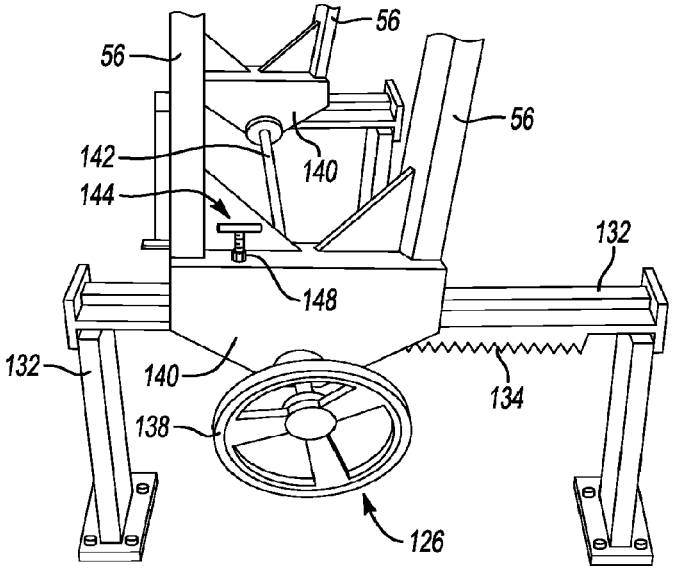
FIG. 16 is another schematic perspective view of the adjustment mechanism.

As best shown in FIGS. 4 and 16, the adjustment mechanism 126 can include a base 132 supporting the frame 56 such that the frame 56 is movable relative to the base 132 between a first adjustment position and a second adjustment position along the third axis 128. Therefore, the base 132 is stationary and the frame 56 is movable relative to the base 132. The first adjustment position can be as illustrated in FIG. 4 and the second adjustment position can be as illustrated in FIG. 16 which is different from the first adjustment position. It is to be appreciated that many different adjustment positions can be achieved by utilizing the adjustment mechanism 126. The cutting device 60 is movable in unison with the frame 56 between the first and second adjustment positions to adjust the position of the cutter 64, and more specifically, the cutter(s) 64, 72, 74. Furthermore, the blocking mechanism 86 is movable in unison with the frame 56 between the first and second adjustment positions. Therefore, the cutting device 60 and the blocking mechanism 86 can be movable in unison with the frame 56 between the first and second adjustment positions. It is to be appreciated that the adjustment mechanism 126 as illustrated in FIGS. 15 and 16 is similar to the adjustment mechanism 126 as illustrated in FIG. 4.

Figure 17:
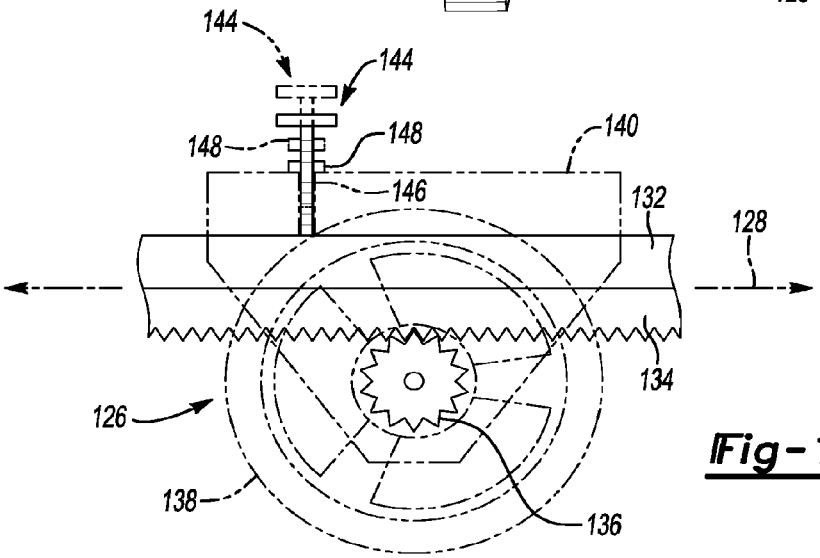
FIG. 17 is a schematic fragmentary side view of a rack and a gear of the adjustment mechanism engaging each other, with a lock device shown in a locked position in solid lines and the lock device shown in an unlocked position in phantom lines, and with a handle and a block shown in phantom lines to illustrate the rack and the gear behind the handle and the block.

Referring to FIGS. 15-17, the adjustment mechanism 126 can include a rack 134 attached to the base 132 and a gear 136 operatively coupled to the frame 56 and engaging the rack 134. The adjustment mechanism 126 can also include a handle 138 supported by the frame 56 and attached to the gear 136 such that the gear 136 moves along the rack 134 when the handle 138 is rotated to move the frame 56 relative to the base 132 to adjust the position of the cutter 64. More specifically, the frame 56 can include a block 140 supporting the handle 138 and the gear 136, with the block 140 movable relative to the base 132. As such, when the handle 138 is rotated, the gear 136 correspondingly rotates and engages various teeth of the rack 134 which moves the frame 56, the blocking mechanism 86 and the cutter(s) 64, 72, 74 relative to the base 132 along the third axis 128. The adjustment mechanism 126 is illustrated as being manually adjustable by the handle 138; however, it is to be appreciated that the adjustment mechanism 126 can be adjusted by other methods, such as automatically, etc. It is to also be appreciated that another rack 134 and another gear 136 engage each other on an opposite side of trenching assembly 54, and thus, the gears 136 on both sides of the frame 56 are mechanically connected to each other with a connector shaft 142 (see FIGS. 7, 16 and 18) to move both sides of the frame 56 in unison along the base 132.

Furthermore, as best shown in FIGS. 4 and 15-17, the adjustment mechanism 126 can include a lock device 144 supported by the frame 56. Specifically, the lock device 144 is supported by the block 140. The lock device 144 is movable between a locked position engaging the base 132 to secure the frame 56 in one of the first and second adjustment positions and an unlocked position disengaging the base 132 to allow movement of the frame 56 relative to the base 132. The locked position is shown in solid lines in FIG. 17 and the unlocked position is shown in phantom lines in FIG. 17 for illustrative purposes only.

Continuing with FIG. 17, the block 140 defines a hole 146 for receiving the lock device 144. The lock device 144 can be threaded and the hole 146 of the block 140 can correspondingly be threaded such that the lock device 144 can move between the locked and unlocked positions to selectively engage the base 132. A lock nut 148 (see FIGS. 15-17) can be utilized to secure the lock device 144 in the desired position. The lock device 144 is illustrated as being manually movable, however, it is to be appreciated that the lock device 144 can be movable by other methods, such as automatically, etc.

Referring to FIGS. 8, 10, 11 and 18, the trenching assembly 54 can further include a collection bin 150 operatively coupled to the cutting device 60 to receive the sand 32 removed by the cutter 64 and to guide the removed sand 32 away from the mold 30. Specifically, the collection bin 150 is attached to the blocking mechanism 86. More specifically, the collection bin 150 is attached to the first and second partitions 88, 90 at another end of the blocking mechanism 86. Therefore, the collection bin 150 moves in unison with the blocking mechanism 86 between the first and second positions along the second axis 62. A chute 152 (see FIG. 18) cooperates with the collection bin 150 to direct the removed sand 32 to a collection area 154.

Figure 19:
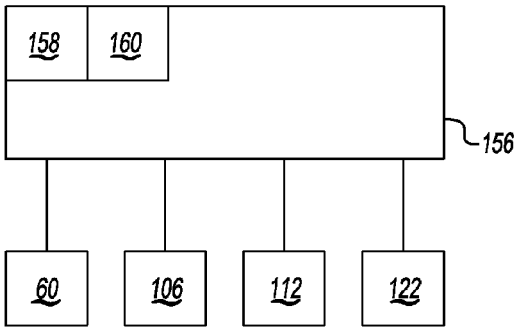
FIG. 19 is a schematic illustration of a controller in communication with various mechanisms and devices.

Turning to FIGS. 4, 5 and 19, the trenching assembly 54 can further include a controller 156 in communication with various mechanisms 86, 106, 126 and devices 60, 112, 122 discussed above. For example, the controller 156 can be in communication with the cutting device 60, the blowing mechanism 106 and the first and second actuator devices 112, 122. Specifically, the controller 156 can be in electrical communication with the first actuator device 112 to move the cutting device 60 between the initial and final positions. Furthermore, the controller 156 can be in electrical communication with the cutting device 60 to selectively activate the electric motor 68 to rotate the cutter(s) 64, 72, 74. Additionally, the controller 156 can be in electrical communication with the second actuator device 122 to move the blocking mechanism 86, as well as the cutting device 60, the blowing mechanism 106 and the collection bin 150, between the first and second positions. In addition, the controller 156 can be in electrical communication with the blowing mechanism 106 to selectively expel the gaseous fluid 110. It is to be appreciated that more than one controller 156 can be utilized and when utilizing a plurality of controllers 156, these controllers 156 can be in communication with each other. It is to also be appreciated that the controller(s) 156 can be in communication with other parts of the system 20, for example, the conveyor 34, the lock device 144 if automated, etc.

The controller 156, shown schematically in FIG. 19, can be embodied as a digital computer device or multiple such devices in communication with the various parts of the system 20. Structurally, the controller 156 can include at least one microprocessor 158 along with sufficient tangible, non-transitory memory 160, e.g., read-only memory (ROM), flash memory, optical memory, additional magnetic memory, etc. The controller 156 can also include any required random access memory (RAM), electrically-programmable read only memory (EPROM), a high-speed clock, analog-to-digital (A/D) and/or digital-to-analog (D/A) circuitry, and any input/output circuitry or devices, as well as any appropriate signal conditioning and buffer circuitry. Instructions for executing the method 1000 (discussed below) of catching overflow of the liquid fluid 48 are recorded in the memory 160 and executed as needed via the microprocessor(s) 158.

Figure 12:
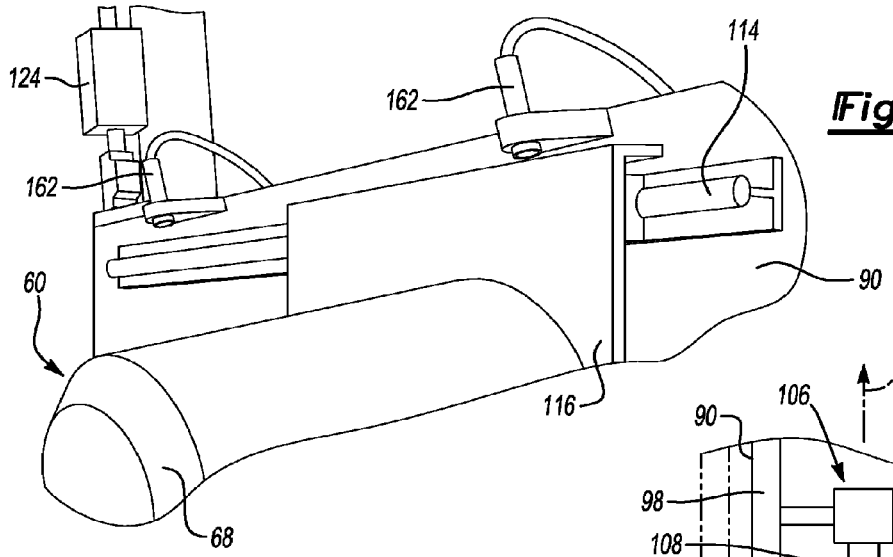
FIG. 12 is a schematic perspective fragmentary view of the cutting device and the blocking mechanism.

As best shown in FIG. 12, the trenching assembly 54 can further include at least one sensor 162, and in certain embodiments, a plurality of sensors 162, operatively coupled to the cutting device 60. Generally, the controller 156 is in communication with the sensors 162. Specifically, the controller 156 is in electrical communication with the sensors 162. One of the first and second partitions 88, 90 can support the sensors 162. As shown in FIG. 12, in one embodiment, the sensors 162 are supported by the first partition 88 and are spaced from the guides 114, 118. Generally, one of the sensors 162 signal the controller 156 when the cutting device 60 is in the initial position and another one of the sensors 162 signals the controller 156 when the cutting device 60 is in the final position. Therefore, when the cutting device 60 is in the final position, the controller 156 signals the electric motor 68 to de-activate to stop rotation of the cutter(s) 64, 72, 74, signals the blowing mechanism 106 to stop expelling gaseous fluid 110 when the cutter(s) 64, 72, 74 stop rotating, signals the blocking mechanism 86 to return to the first position and signals the first actuator device 112 to return the cutting device 60 to the initial position. As the cutting device 60 moves, the bracket 116 moves away from one sensor 162 toward another sensor 162. The bracket 116 selectively passes under the sensors 162. The sensors 162 can identify the position of the bracket 116 and thus the cutting device 60 depending on which sensor 162 the bracket 116 passes partially under.

Figure 22:
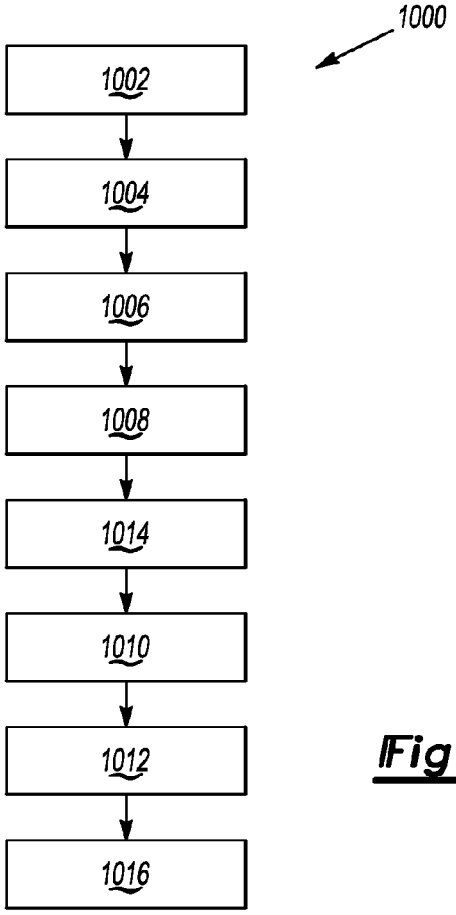
FIG. 22 is a schematic flowchart of a method of catching overflow of a liquid fluid utilized to cast a component.

Referring to FIG. 22, the present disclosure also provides a method 1000 of catching overflow of the liquid fluid 48 utilized to cast the component 22. The method 1000 includes compacting 1002 sand 32 to form the mold 30. As discussed above, the mold 30 includes the first and second sides 38, 40 spaced from each other along the first axis 42, and the mold 30 includes the top surface 44 between the first and second sides 38, 40. As also discussed above, the top surface 44 defines the opening 46. More specifically, compacting 1002 the sand 32 to form the mold 30 can include compacting sand 32 to form a plurality of molds 30, with each of the molds 30 defining one opening 46 and the molds 30 forming one continuous top surface 44, one continuous first side 38 and one continuous second side 40.

The mold 30 moves along the conveyor 34 such that the mold 30 is disposed in the window 58 of the frame 56 below the cutting device 60. Therefore, the method 1000 can include moving 1004 the mold 30 into the window 58 of the frame 56 to create the recess 66. More specifically, moving 1004 the mold 30 can include moving the molds 30 one at a time into the window 58 of the frame 56 to create one recess 66 at a time. The conveyor 34 moves each of the molds 30 into and out of the window 58 along the third axis 128.

The method 1000 also includes moving 1006 the cutting device 60 along the second axis 62 transverse to the first axis 42 between the first position and the second position. As indicated above, the cutter 64 of the cutting device 60 is in the disengaged position spaced from the top surface 44 of the mold 30 when the cutting device 60 is in the first position and the cutter 64 is in the engaged position engaging the top surface 44 of the mold 30 when the cutting device 60 is in the second position. Simply stated, the cutting device 60 is movable up and down relative to the top surface 44 of the mold 30. Moving 1006 the cutting device 60 along the second axis 62 can include moving the cutting device 60 from the first position to the second position to create the recess 66. Therefore, after the recess 66 is created, the cutting device 60 moves from the second position back to the first position to start this process over to create the next recess 66 of the next mold 30.

The method 1000 also includes actuating 1008 the cutter 64 of the cutting device 60 when the cutting device 60 is in the second position and the cutter 64 is in the engaged position to remove sand 32 from the top surface 44 to define the recess 66 therein to catch overflow of the liquid fluid 48. More specifically, actuating 1008 the cutter 64 can include rotating the cutter 64. Specifically, actuating 1008 the cutter 64 can include activating the electric motor 68 of the cutting device 60 to rotate the cutter 64. It is to be appreciated actuating the cutter 64 can include actuating the cutters 64, 72, 74 when the cutters 64, 72, 74 are in the engaged position to create the recess 66 presenting the width 80, and thus, rotating the cutter 64 can include rotating the cutters 64, 72, 74. Furthermore, activating the electric motor 68 can include signaling the electric motor 68, via the controller 156, to activate to rotate the cutters 64, 72, 74.

The method 1000 can also include moving 1010 the cutting device 60 along the first axis 42 between the initial position and the final position. Generally, to create the recess 66, the cutting device 60 moves from the initial position to the final position. As such, the cutter 64 engages the top surface 44 of the mold 30 during movement from the initial position to the final position. Therefore, to create the recess 66, actuating 1008 the cutter 64 when the cutter 64 is in the engaged position occurs before moving 1010 the cutting device 60 along the first axis 42 between the initial and final positions. Furthermore, once the recess 66 is created, the cutting device 60 moves from the final position back to the initial position to start this process over to create the next recess 66 of the next mold 30.

Additionally, moving 1010 the cutting device 60 along the first axis 42 can include activating the first actuator device 112 to move the cutting device 60 along the first axis 42 between the initial and final positions. Specifically, to create the recess 66, the first actuator device 112 is activated to move the cutting device 60 from the initial position to the final position. After the recess 66 has been created, the first actuator device 112 is activated again to move the cutting device 60 from the final position back to the initial position. Therefore, moving 1010 the cutting device 60 along the first axis 42 can include signaling the first actuator device 112, via the controller 156, to activate to move the cutting device 60 from the initial position to the final position. It is to be appreciated that the controller 156 can signal the first actuator device 112 to move the cutting device 60 from the final position back to the initial position.

Once the recess 66 has been created, the method 1000 can include stopping 1012 the cutter 64 when the cutting device 60 is in the final position. In other words, stopping 1012 the cutter 64 occurs after actuating 1008 the cutter 64. More specifically, stopping 1012 the cutter 64 can include stopping rotation of the cutter 64 when the cutting device 60 is in the final position. Specifically, stopping 1012 the cutter 64 can include de-activating the electric motor 68 of the cutting device 60 to stop rotation of the cutter 64. Therefore, de-activating the electric motor 68 can include signaling the electric motor 68, via the controller 156, to de-activate to stop rotation of the cutter 64. It is to be appreciated that stopping 1012 the cutter 64 can include stopping the cutters 64, 72, 74, and thus, stopping rotation of the cutter 64 can include stopping rotation of the cutters 64, 72, 74, etc.

The method 1000 further includes utilizing 1014 at least one of the blocking mechanism 86, the blowing mechanism 106 and the adjustment mechanism 126 to assist the cutting device 60. Generally, utilizing 1014 at least one of the mechanisms 86, 106, 126 occurs before moving 1010 the cutting device 60 along the first axis 42 between the initial and final positions. Furthermore, utilizing 1014 at least one of the mechanisms 86, 106, 126 occurs before stopping 1012 the cutter 64 when the cutting device 60 is in the final position. It is to be appreciated that utilizing 1014 the mechanisms 86, 106, 126 can occur in various orders as discussed below. These mechanisms 86, 106, 126 are each detailed below.

For example, utilizing 1014 the blocking mechanism 86 can include moving the blocking mechanism 86 in unison with movement of the cutting device 60 along the second axis 62 between the first position with the cutter 64 in the disengaged position and the second position with the cutter 64 in the engaged position. More specifically, in certain embodiments, moving the blocking mechanism 86 in unison with movement of the cutting device 60 can include activating the second actuator device 122 to move the blocking mechanism 86 and the cutting device 60 in unison between the first and second positions. Therefore, before creating the recess 66, the blocking mechanism 86 and the cutting device 60 are in the first position with the cutter(s) 64, 72, 74 in the disengaged position. Therefore, to create the recess 66, moving the blocking mechanism 86 in unison with movement of the cutting device 60 along the second axis 62 occurs before actuating 1008 the cutter 64. Moving the blocking mechanism 86 in unison with movement of the cutting device 60 can include signaling the second actuator device 122, via the controller 156, to activate to move the blocking mechanism 86 and the cutting device 60 from the first position to the second position. It is to be appreciated that the controller 156 can signal the second actuator device 122 to move the blocking mechanism 86 and the cutting device 60 from the second position back to the first position.

The second actuator device 122 is activated to move the blocking mechanism 86 and the cutting device 60 in unison along the second axis 62 to the second position such that the cutter(s) 64, 72, 74 move to the engaged position. When the blocking mechanism 86 and the cutting device 60 are in the second position, the second actuator device 122 is de-activated until after the recess 66 is created in the top surface 44 of the mold 30. Furthermore, when the blocking mechanism 86 and the cutting device 60 are in the second position, the cutter(s) 64, 72, 74 are in the engaged position, and thus, the electric motor 68 can be activated to rotate the cutter(s) 64, 72, 74. After the recess 66 is created, the second actuator device 122 is activated to move the blocking mechanism 86 and the cutting device 60 back to the first position to start this process over for the next mold 30. More specifically, after the recess 66 is created, the electric motor 68 is de-activated to stop rotation of the cutter(s) 64, 72, 74 before the second actuator device 122 is activated to move the blocking mechanism 86 and the cutting device 60 back to the first position. Simply stated, the cutter(s) 64, 72, 74 are not rotating when the blocking mechanism 86 and the cutting device 60 move back to the first position.

Furthermore, moving the blocking mechanism 86 can include engaging the first partition 88 and the second partition 90 of the blocking mechanism 86 with the top surface 44 of the mold 30 when in the second position to contain the sand 32 removed from the top surface 44 of the mold 30 by the cutter 64. In certain embodiments, engaging the first partition 88 and the second partition 90 of the blocking mechanism 86 with the top surface 44 of the mold 30 when in the second position can include engaging the flexible seal 100 of the first and second partitions 88, 90 with the top surface 44 of the mold 30 when in the second position. As indicated above, the first and second partitions 88, 90 are spaced from each other to define the gap 92 therebetween such that the recess 66 is created between the first and second partitions 88, 90. Generally, actuating 1008 the cutter 64 occurs after engaging the first and second partitions 88, 90 with the top surface 44 of the mold 30 when in the second position. More specifically, actuating the cutters 64, 72, 74 occurs after engaging the first and second partitions 88, 90 with the top surface 44 of the mold 30 when in the second position. Therefore, the sand 32 removed from the top surface 44 of the mold 30 remains contained between the first and second partitions 88, 90. As such, the sand 32 being removed cannot enter either of the adjacent openings 46 when the first and second partitions 88, 90 are in the second position while creating the recess 66. After the recess 66 is created, the cutting device 60 is in the final position and the first and second partitions 88, 90 are in the second position engaging the top surface 44, and then the electric motor 68 can be de-activated to stop rotation of the cutter(s) 64, 72, 74. Once the cutter(s) 64, 72, 74 stop moving, the second actuator device 122 can be activated to move the blocking mechanism 86 and the cutting device 60 from the second position back to the first position to start this process over to create the next recess 66 of the next mold 30.

In certain embodiments, utilizing 1014 the blowing mechanism 106 can include actuating the blowing mechanism 106 to move the sand 32 removed from the top surface 44 of the mold 30 by the cutter 64 toward one of the first and second sides 38, 40 of the mold 30. More specifically, actuating the blowing mechanism 106 can include expelling the gaseous fluid 110 to move the sand 32 removed from the top surface 44 of the mold 30 toward one of the first and second sides 38, 40 of the mold 30. The blowing mechanism 106 can be actuated before, during or after movement of the cutting device 60 from the first position to the second position. In one embodiment, actuating the blowing mechanism 106 can occur before actuating 1008 the cutter(s) 64, 72, 74. In another embodiment, actuating the blowing mechanism 106 can occur after actuating 1008 the cutter(s) 64, 72, 74. In yet another embodiment, actuating the blowing mechanism 106 can occur simultaneously with actuating 1008 the cutter(s) 64, 72, 74. Generally, the gaseous fluid 110 is expelled as the cutter(s) 64, 72, 74 create the recess 66. Therefore, the gaseous fluid 110 can be expelled during movement of the cutter(s) 64, 72, 74 from the initial position to the final position. Furthermore, before creating the recess 66, expelling the gaseous fluid 110 can occur before moving 1010 the cutting device 60 along the first axis 42. Actuating the blowing mechanism 106 can include signaling the blowing mechanism 106, via the controller 156, to expel the gaseous fluid 110.

In one embodiment, utilizing 1014 the blowing mechanism 106 can further include moving the blocking mechanism 86 and the blowing mechanism 106 in unison along the second axis 62 between the first and second positions. Furthermore, moving 1010 the cutting device 60 along the first axis 42 between the initial and final positions can include moving the cutting device 60 between the initial and final positions independently of the blocking mechanism 86 and the blowing mechanism 106. Therefore, the blocking mechanism 86, the blowing mechanism 106 and the cutting device 60 move in unison along the second axis 62 and independently of this movement, the cutting device 60 moves along the first axis 42. Therefore, the blowing mechanism 106 remains stationary relative to the first axis 42 such that the cutting device 60 moves independently of the blowing mechanism 106 along the first axis 42 between the initial and final positions. In another embodiment, moving 1010 the cutting device 60 along the first axis 42 between the initial and final positions can include moving the cutting device 60 and the blowing mechanism 106 in unison between the initial and final positions independently of the blocking mechanism 86.

Generally, the gaseous fluid can be expelled out the nozzle 108. The method 1000 can further include stopping 1016 the flow of the gaseous fluid 110 out of the nozzle 108 when the cutting device 60 in the final position. Specifically, stopping 1016 the flow of the gaseous fluid 110 occurs after stopping rotation of the cutter 64. Stopping 1016 the flow of the gaseous fluid 110 can include signaling the blowing mechanism 106, via the controller 156, to stop the flow. Therefore, after the recess 66 is created, the electric motor 68 is de-activated to stop rotation of the cutter(s) 64, 72, 74 before the blowing mechanism 106 is de-activated to stop expelling the gaseous fluid 110. Simply stated, the gaseous fluid 110 will continue to be expelled until the cutters 64, 72, 74 stop rotating, which ensures that the cut sand 32 is removed from the cutters 64, 72, 74 and the mold 30 to minimize the cut sand 32 from entering either of the adjacent openings 46. Specifically, expelling the gaseous fluid 110 can include moving the cut sand 32 away from the cutters 64, 72, 74 and the mold 30, and into the collection bin 150. As such, the collection bin 150 guides the removed sand 32 into the collection area 154 away from the mold 30. Stopping 1016 the flow of the gaseous fluid 110 out of the nozzle 108 can include closing the nozzle 108 to stop expelling the gaseous fluid 110 out of the nozzle 108 when in the final position. Specifically, closing the nozzle 108 occurs after stopping rotation of the cutter 64. Closing the nozzle 108 can include signaling the blowing mechanism 106, via the controller 156, to close the nozzle 108.

As discussed above, the recess 66 is spaced from the opening 46. As such, utilizing 1014 the adjustment mechanism 126 can include actuating the adjustment mechanism 126 to move the cutting device 60 along the third axis 128 transverse to the first axis 42 to adjust the position of the cutter 64 relative to the opening 46 of the mold 30. Adjusting the position of the cutter 64 correspondingly adjusts the predetermined distance 130 of the recess 66 from the opening 46. Specifically, positioning the cutters 64, 72, 74 between two adjacent openings 46 correspondingly positions the recess 66 the predetermined distance 130 between the adjacent openings 46. Actuating the adjustment mechanism 126 occurs before moving 1006 the cutting device 60 along the second axis 62 transverse to the first axis 42 between the first position and the second position. Actuating the adjustment mechanism 126 can further include rotating the handle 138 to adjust the position of the cutter(s) 64, 72, 74 relative to the opening 46 of the mold 30. Furthermore, actuating the adjustment mechanism 126 can include disengaging the lock device 144 from the base 132 to allow movement of the frame 56 along the third axis 128 to adjust the position of the cutters 64, 72, 74. Once the desired position of the cutters 64, 72, 74 is determined, the lock device 144 engages the base 132 to secure the frame 56, and thus, the cutters 64, 72, 74 in that position.

The method 1000 can be repeated to create as many recesses 66 as desired. It is to be appreciated that the order or sequence of performing the method 1000 as identified in the flowchart of FIG. 22 is for illustrative purposes and other orders or sequences are within the scope of the present disclosure. It is to also be appreciated that the method 1000 can include other features not specifically identified in the flowchart of FIG. 22.

While the best modes for carrying out the disclosure have been described in detail, those familiar with the art to which this disclosure relates will recognize various alternative designs and embodiments for practicing the disclosure within the scope of the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A method of catching overflow of a liquid fluid utilized to cast a component, the method comprising:

compacting sand to form a mold, with the mold including a first side and a second side spaced from each other along a first axis, and with the mold including a top surface between the first and second sides, and the top surface defining an opening;

moving a cutting device along a second axis transverse to the first axis between a first position and a second position, with a cutter of the cutting device being in a disengaged position spaced from the top surface of the mold when the cutting device is in the first position and the cutter being in an engaged position engaging the top surface of the mold when the cutting device is in the second position;

actuating the cutter of the cutting device when the cutting device is in the second position and the cutter is in the engaged position to remove sand from the top surface to define a recess therein to catch overflow of the liquid fluid, with the recess spaced from the opening.

2. A method as set forth in claim 1 further comprising moving the cutting device along the first axis between an initial position and a final position, with the cutter engaging the top surface of the mold during movement from the initial position to final position.

3. A method as set forth in claim 2 wherein moving the cutting device along the first axis includes activating a first actuator device to move the cutting device along the first axis between the initial and final positions.

4. A method as set forth in claim 2 further comprising stopping the cutter when the cutting device is in the final position.

5. A method as set forth in claim 1 further comprising utilizing at least one of a blocking device, a blowing device, and an adjustment device to assist the cutting device.

6. A method as set forth in claim 5 wherein utilizing the blocking device includes moving the blocking device in unison with movement of the cutting device along the second axis between the first position with the cutter in the disengaged position and the second position with the cutter in the engaged position.

7. A method as set forth in claim 6 wherein moving the blocking device includes engaging a first partition and a second partition of the blocking device with the top surface of the mold when in the second position to contain the sand removed from the top surface of the mold by the cutter, with the first and second partitions spaced from each other to define a gap therebetween such that the recess is created between the first and second partitions.

8. A method as set forth in claim 7 wherein actuating the cutter occurs after engaging the first and second partitions with the top surface of the mold when in the second position.

9. A method as set forth in claim 6 wherein moving the blocking device in unison with movement of the cutting device includes activating a second actuator device to move the blocking device and the cutting device in unison between the first and second positions.

10. A method as set forth in claim 5 wherein utilizing the blowing device includes actuating the blowing device to move the sand removed from the top surface of the mold by the cutter toward one of the first and second sides of the mold.

11. A method as set forth in claim 10 wherein actuating the blowing device includes expelling a gaseous fluid to move the sand removed from the top surface of the mold toward one of the first and second sides of the mold.

12. A method as set forth in claim 11: further comprising moving the cutting device along the first axis between an initial position and a final position, with the cutter engaging the top surface of the mold during movement from the initial position to the final position; and wherein moving the cutting device along the first axis between the initial and final positions includes moving the cutting device between the initial and final positions independently of the blocking device and the blowing device.

13. A method as set forth in claim 12: wherein the gaseous fluid is expelled out a nozzle; wherein actuating the cutter includes rotating the cutter; further comprising stopping rotation of the cutter when the cutting device is in the final position; further comprising stopping the flow of the gaseous fluid out of the nozzle when the cutting device is in the final position; and wherein stopping the flow of the gaseous fluid occurs after stopping rotation of the cutter.

14. A method as set forth in claim 10 wherein utilizing the blowing device further includes moving the blocking device and the blowing device in unison along the second axis between the first and second positions.

15. A method as set forth in claim 5 wherein utilizing the adjustment device includes actuating the adjustment device to move the cutting device along a third axis transverse to the first axis to adjust a position of the cutter relative to the opening of the mold.

* * * * *